US005671539A

United States Patent [19]

Barone

[11] Patent Number: 5,671,539

[45] Date of Patent: Sep. 30, 1997

[54] HOLSTER APPARATUS FOR LUMINESCENT WEAPON ELEMENTS

[76] Inventor: Larry A. Barone, P.O. Box 344, Goodyear, Maricopa County, Ariz. 85338

[21] Appl. No.: 723,986

[22] Filed: Sep. 30, 1996

[51] Int. Cl.[6] ..... F41G 1/32

[52] U.S. Cl. ..... 33/241; 362/110

[58] Field of Search ..... 362/110; 33/241

[56] References Cited

U.S. PATENT DOCUMENTS 4,003,507 1/1977 Elton ..... 33/241

5,101,589 4/1992 Duncan .

*Primary Examiner*—Carroll B. Dority

*Attorney, Agent, or Firm*—H. Gordon Shields

[57] ABSTRACT

Holster apparatus for a hand held weapon and on which weapon are photoluminescent elements, chargeable by light produced by a lamp disposed in the holster and a switch controlled battery is used to power the lamp. Mirror elements may be used to insure that the light produced by the lamp is spread relatively uniformly to all of the photoluminescent elements. Depending on the size of the weapon disposed in the holster apparatus, a plurality of lamps may be used, and a switch, which is preferably spring loaded to the off position, is actuated as desired by the user of the holster and weapon.

15 Claims, 2 Drawing Sheets

HOLSTER APPARATUS FOR LUMINESCENT WEAPON ELEMENTS

BACKGROUND OF THE INVENTION

1. Field of the Invention

This invention relates to holsters for hand held weapons and, more particularly, to holster apparatus including elements for charging photoluminescent material on a hand held weapon disposed in the holster.

2. Description of the Prior Art

U.S. Pat. No. 5,105,589 (Duncan) discloses a pistol with photoluminescent material on front and rear sights and on the barrel. However, there is no structure disclosed for "charging" the photoluminescent material.

The invention claimed and described herein includes apparatus securable to a holster for charging the photoluminescent material. In other words, the holster apparatus includes built in photoluminescent charging elements.

SUMMARY OF THE INVENTION

The invention described and claimed herein comprises a holster for receiving a hand held weapon, such as a pistol, having photoluminescent material for aiming purposes in low light, and the holster includes elements for charging the photoluminescent material. The photoluminescent charging elements include mirror elements, lamps, a lens, and a battery source. The lamps are battery powered, and a switch controls the current flowing from the battery source to the lamp elements.

Among the objects of the present invention are the following:

To provide new and useful holster apparatus;

To provide new and useful holster apparatus for use with a pistol having photoluminescent elements thereon;

To provide new and useful apparatus for charging photoluminescent elements;

To provide new and useful photoluminescent charging apparatus including a battery and a lamp;

To provide new and useful photoluminescent apparatus including a lamp, a battery for providing electric current for the lamp, and a lens for focusing light from the lamp;

To provide new and useful apparatus for charging photoluminescent material including a lamp and mirror elements for reflecting light from the lamp onto the photoluminescent material;

To provide new and useful holster apparatus in which is disposed a pistol having photoluminescent material thereon and including a lamp, a battery for powering the lamp, and a switch for controlling the flow of current from the battery to the lamp; and To provide new and useful photoluminescent charging apparatus in a holster having a weapon and photoluminescent materials thereon.

DESCRIPTION OF THE PREFERRED EMBODIMENT

Figure 1:
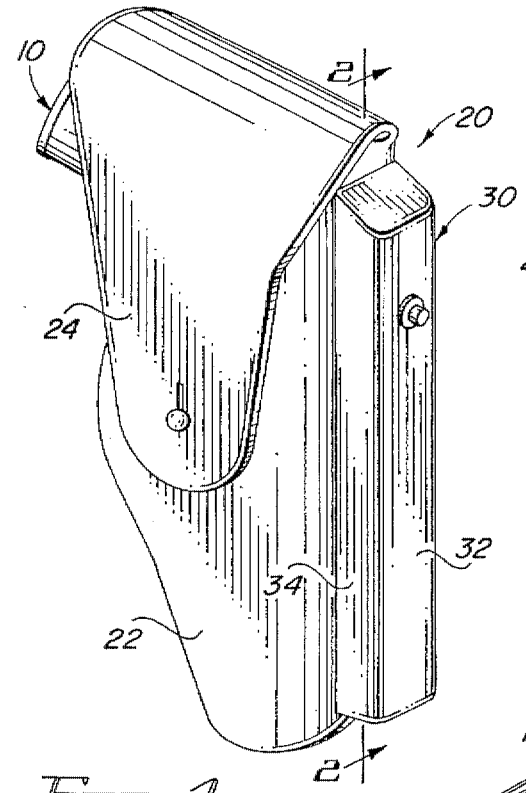
FIG. 1 is a perspective view of holster apparatus embodying the present invention.

FIG. 1 is a perspective view of holster apparatus 20 of the present invention. The holster apparatus 20 includes three general portions, including a pistol receiving portion 22, a flap 24 secured to and pivoting on the pistol receiving portion and enclosing the upper end of the pistol receiving portion, in a well known and understood manner, and a lamp portion or lamp housing 30.

Figure 2:
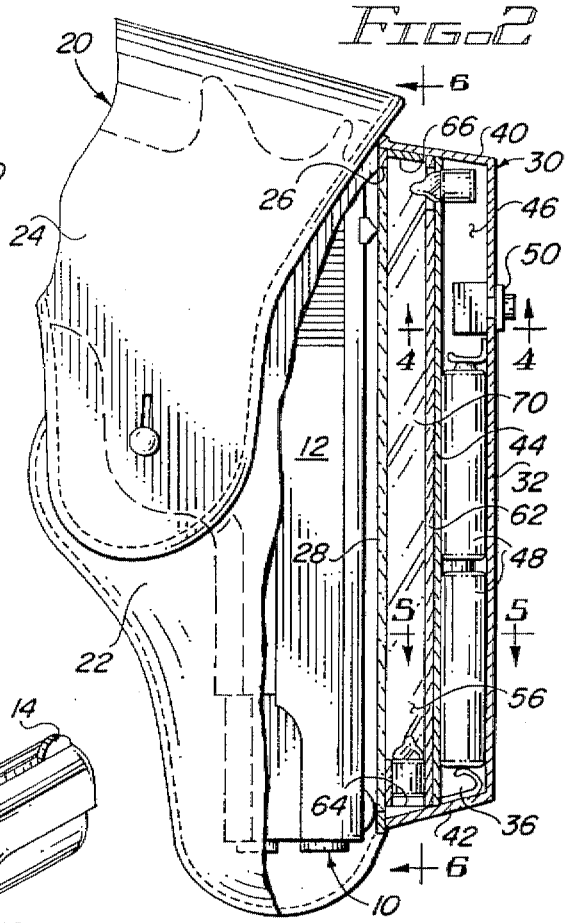
FIG. 2 is a view in partial section taken generally along line 2—2 of FIG. 1.

FIG. 2 comprises a side view, partially broken away and in partial section, taken generally along line 2—2 of FIG. 1.

Figure 3:
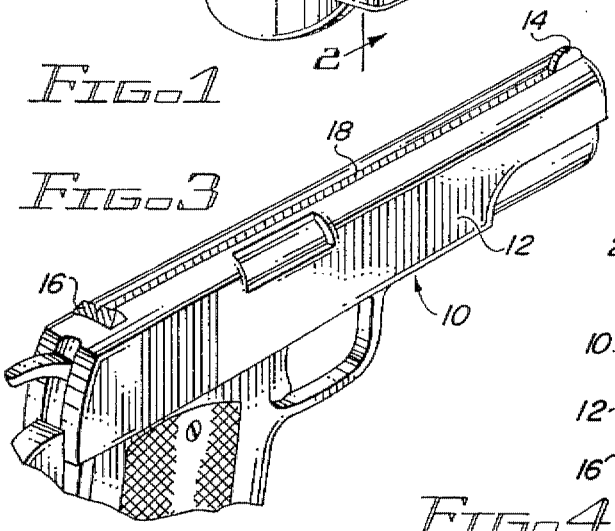
FIG. 3 is a perspective view of a portion of a pistol with which the apparatus of the present invention is used.

FIG. 3 comprises a perspective view of a portion of a hand held weapon, illustrated as a pistol 10, which is received into, or is disposed into, the pistol receiving portion 22 of the holster apparatus 20. The pistol 10 includes a slide 12, and on the slide 12 are two sights, including a from sight 14 and a rear sight 16. Extending between the two sights 14 and 16 is a strip 18 of photoluminescent material. The rear portions of both the front sight 14 and the rear sight 16 also include photoluminescent material thereon.

The purpose of the photoluminescent material has been discussed above in conjunction with the '589 (Duncan) patent. The lamp portion 30 includes lamp elements for charging the photoluminescent strip 18 and the photoluminescent material on the front sight 14 and the rear sight 16.

Figure 4:
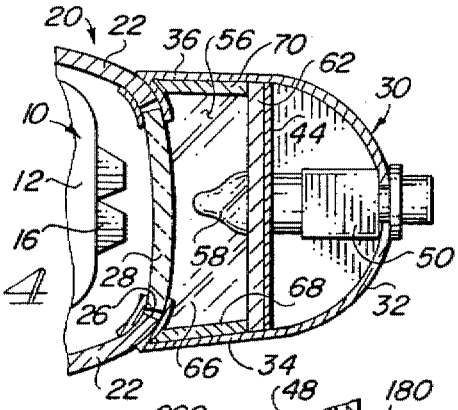
FIG. 4 is a view in partial section taken generally along line 4—4 of FIG. 2.
Figure 5:
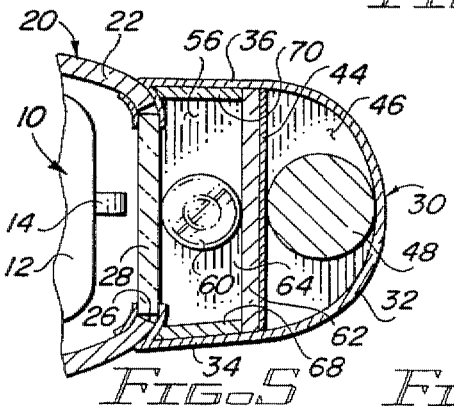
FIG. 5 is a view in partial section taken generally along line 5—5 of FIG. 2.
Figure 6:
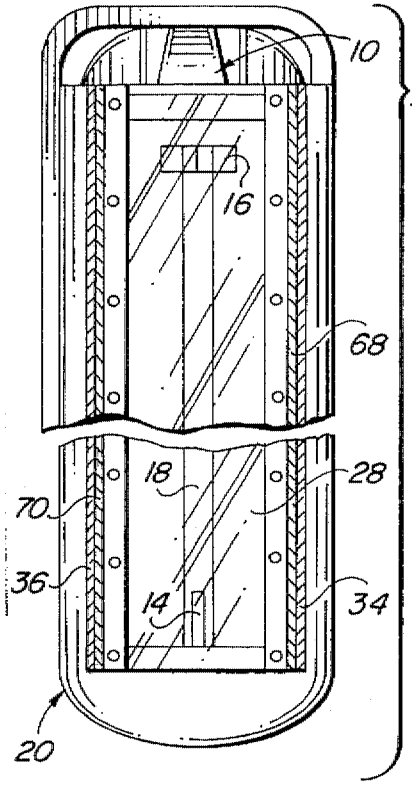
FIG. 6 is a view in partial section taken generally along line 6—6 of FIG. 2.

Details of the holster apparatus 20 and the lamp or housing portion 30 are illustrated additionally in FIGS. 4, 5, and 6. For the following discussion, reference will primarily be made to FIGS. 1, 2, 4, 5, and 6.

There is an elongated opening 26 on the top of the pistol receiving portion 22 of the holster apparatus 20. The elongated opening is covered by a transparent lens or strip 28. The lamp portion 30 is disposed about, or encloses, the transparent lens or strip 28. The lamp portion or housing 30 is secured to the pistol receiving portion 22 over the elongated opening 26. The elongated opening 26, with its transparent strip 28, covers or is disposed adjacent to the slide 12 and includes the front and rear sights 14 and 16, respectively, and the strip 18. Thus, the from sight 14 and the rear sight 16, and the entire strip 18, are subject to the illumination from lamps in the lamp portion 30.

The lamp or housing portion 30 of the holster apparatus 20 is appropriately secured to the pistol receiving portion 22. The lamp portion 30 is disposed above or adjacent to the transparent strip 28, and covers the lens or strip 28. The lens or strip 28 provides a cover for the pistol 10 and also provides communication between the lamp portion 30 and the top of the pistol 10, and particularly provides communication for light from the lamp portion 30 to the photoluminescent material 18 and the photoluminescent material on the sights 14 and 16.

The lamp portion 30 is shown in two configurations, a rather rectangular configuration in FIG. 1 and a more rounded configuration in FIGS. 4 and 5. The lamp portion 30 includes a top 32 which blends to a pair of sides 34 and 36, and a pair of ends, including an upper end 40 and a lower end 42.

Within the lamp or housing portion 30 is a partition 44 which extends generally parallel to the strip 28 and to the top 32. The partition or wall 44 divides the housing 30 into two compartments, an upper battery and switch compartment 46 and a lower or lamp compartment 56. A pair of batteries 48 are disposed in the upper compartment 46 and are appropriately electrically connected to a switch 50. The switch 50 is spring loaded to the off position, and accordingly a positive action is required by a user of the apparatus 20 to actuate and hold the switch 50 for illumination purposes.

Within the lower or lamp compartment 56 are two lamps or bulbs 58 and 60, and mirrors 62, 64, 66, 68, and 70. The mirror 62 is an upper mirror, appropriately secured to the bottom of the partition 44. The mirror 64 is a bottom or front end mirror disposed against the end 42, and the mirror 66 is a top end mirror, disposed against the upper end 40. The mirrors 64 and 66 insure that light from the lamps impinges on the sights 14 and 16, respectively. The mirrors 68 and 70 are side mirrors, reflecting light, along with the mirror 62, onto the strip 18. The mirrors reflect the light through the transparent strip or lens 28.

If desired, the strip 28 may have a convex configuration as illustrated in FIG. 4, so as to focus the light from the compartment 56 onto the strip 18 and the sights 14 and 16. The strip 18 and the sights 14 and 16 thus receive maximum benefit of the lamps for charging the photoluminescent material on the pistol 10.

Figure 7:
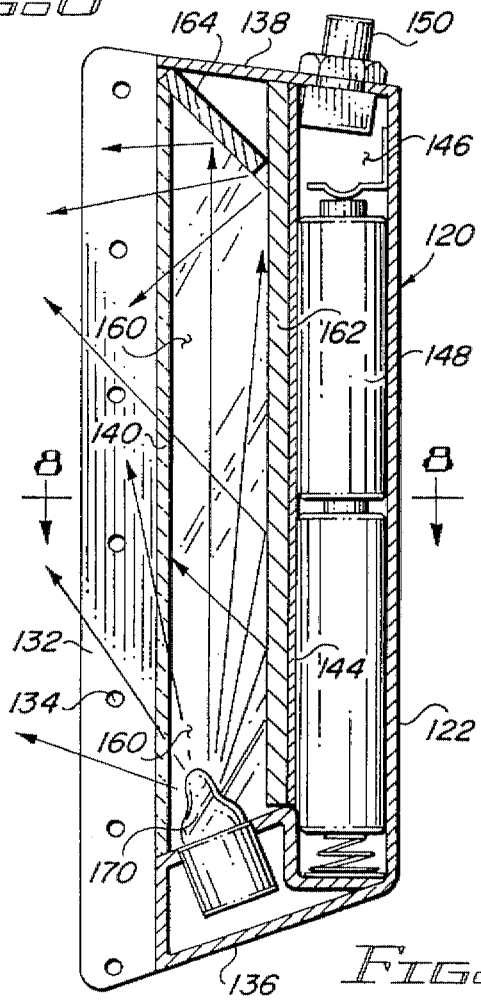
FIG. 7 is a side view in partial section of an alternate embodiment of the apparatus of the present invention.
Figure 8:
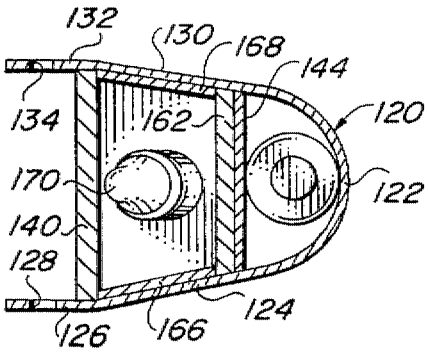
FIG. 8 is a view in partial section taken generally along line 8—8 of FIG. 7.

FIG. 7 comprises a view in partial section of an alternate embodiment lamp portion 120. FIG. 8 is a view in partial section of the lamp or housing portion 120 taken generally along line 8—8 of FIG. 7. For the following discussion of the lamp or housing portion 120, reference will primarily be made to FIGS. 7 and 8.

The lamp or housing portion 120 may be used for a smaller pistol than the pistol illustrated in FIG. 3, and includes a removable fastening system for securing the lamp portion 120 to a holster. The lamp portion 120 includes a top wall 122 and a pair of side walls 124 and 130 extending from the top wall 122. At the "lower" ends of the sides, remote from the top 122, the sides each include a flap. The side 124 includes a flap 126, and a plurality of apertures 128 extends through the flap 126. The side 130 includes a flap 132, and a plurality of apertures 134 extend through the flap 132. The apertures 128 and 132, with appropriate fastening elements, well known and understood, are used to removably secure the lamp portion 120 to a holster (not shown).

Closing the lamp portion 120 are end walls 136 and 138. The end 136 is a front or bottom end wall, and the end 138 is a rear or upper end wall. The ends 136 and 138 are appropriately secured to, or are a part of, the top 122 and the sides 124 and 130.

A wall 144 divides the lamp portion into two chambers, a battery and switch chamber 146 and a lamp chamber 160. Within the battery and switch chamber 146 are two batteries 148 and a switch 150. The switch 150 is appropriately electrically connected to the batteries 148. The switch 150 is spring loaded to the off position, and accordingly must be actuated by a positive action by the user and must be held to the "on" position for charging the photoluminescent material, just as the switch 50 must be actuated and held "on."

Within the lamp chamber 160 are mirrors 162, 164, 166, and 168, and a single lamp 170. The lamp 170 is held by a bracket adjacent to the end wall 136. The mirror 162 is a top mirror, extending longitudinally and secured to the partition or divider wall 144. The mirror 164 is an rear end mirror, angularly adjusted relative to the end wall 138 to reflect light through a transparent lens or panel 140 onto photoluminescent material on a pistol (not shown) in a holster (also not shown) to which the lamp portion 120 is secured. The mirrors 166 and 168 are side mirrors, also extending longitudinally and secured to the side walls 124 and 130, respectively. The mirrors 166 and 168 also reflect light through the transparent panel or lens 140.

While the transparent panel 140 is shown as part of the lamp portion 120, it is obvious that it could also be part of the pistol receiving portion of the holster apparatus of which the lamp portion is a part. Such is shown in conjunction with the apparatus of FIGS. 1, 2 and 4–6.

Figure 9:
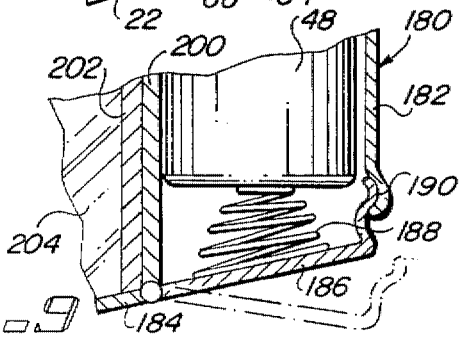
FIG. 9 is a view in partial section of an alternate embodiment of a portion of the apparatus of the present invention.

FIG. 9 comprises a fragmentary view in partial section of an alternate embodiment of a lamp or housing portion 180 illustrating a simplified way of replacing batteries. The lamp portion 180 includes a top wall 182 and an end wall 184, and a door panel 186 is hingedly connected to the end wall 184 adjacent to the top wall 182. A spring 188, part of the electrical elements associated with the batteries, of which a battery 48 is illustrated, is secured to the door panel 186. A simple corrugated clip fastener arrangement 190 is built into the door panel 186 and the adjacent portion of the top wall 182.

Other elements shown in FIG. 9 include a partition wall 200 and mirror elements 202 and 204.

In use, the charging of the photoluminescent material must be accomplished by a positive action of the user of the holster apparatus. Since the switch elements are spring loaded to the off position, a switch must be held "on" for charging.

The flap 24, shown in FIG. 1, covers the top end of the lamp portion 30 and prevents the escape of any light which could affect the night vision of a user of the apparatus. Experience has shown that only a few seconds are required to charge photoluminescent material in contemporary use. The photoluminescent material, once charged for a few seconds, will then retain its illuminated properties for a time period generally sufficient for most situations.

Figure 10:
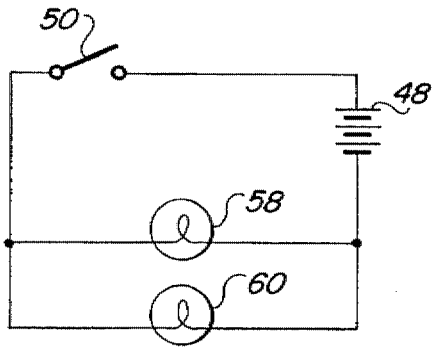
FIG. 10 is a schematic circuit diagram of electrical elements included in the present invention.

FIG. 10 is a schematic diagram illustrating the electrical circuitry of the present invention. The environment for the circuitry is the embodiment best illustrated in FIGS. 2, 4, and 5. The batteries 48 are connected to the lamps 58 and 60 by the switch 50. The lamps 58 and 60 are in parallel between the switch 50 and the pair of batteries 48.

The various conductors associated with the circuit elements are broadly illustrated in FIG. 10. Such are well known and understood.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What I claim is:

1. Apparatus for illuminating photoluminescent material on a weapon comprising in combination:

a holster for holding the weapon;

an opening in the holster adjacent to the photoluminescent material on the weapon;

a lamp housing secured to the holster adjacent to the opening, including a first portion for holding a battery, and a second portion disposed over the opening for holding a lamp for providing illumination for the photoluminescent material; and switch means for connecting the lamp and the battery to provide light to illuminate the photoluminescent material.

2. The apparatus of claim 1 which further includes mirror means in the second portion for reflecting light from the lamp through the opening.

3. The apparatus of claim 2 in which the lamp housing further includes a top;

a pair of sides extending from the top to the holster;

a pair of ends secured to the top and to the sides and extending to the holster; and a partition dividing the lamp housing into the two portions.

4. The apparatus of claim 3 in which the mirror means include a first mirror secured to the partition in the second portion, second and third mirrors secured to the pair of sides in the second portion, and fourth and fifth mirrors secured to the pair of ends in the second portion.

5. The apparatus of claim 1 which further includes a strip of transparent material over the openings and through which light shines on the photoluminescent material.

6. The apparatus of claim 5 in which the ship of transparent material comprises a lens for focusing the light on the photoluminescent material.

7. Holster apparatus for illuminating photoluminescent material on a weapon disposed in the apparatus comprising in combination:

a holster for receiving a weapon having photoluminescent material thereon;

a housing secured to the holster;

lamp means in the housing for providing light for the photoluminescent material;

battery means in the housing for providing electrical current for the lamp means; and switch means for connecting the battery means and the lamp means.

8. The apparatus of claim 7 which further includes an opening between the holster and the housing through which light shines on the photoluminescent material.

9. The apparatus of claim 8 which further includes a strip of transparent material covering the opening.

10. The apparatus of claim 8 which further includes a convex lens disposed over the opening to focus the light onto the photoluminescent material.

11. The apparatus of claim 7 in which the switch means comprises a switch spring loaded to the off position.

12. The apparatus of claim 7 in which the battery means comprises a plurality of batteries.

13. The apparatus of claim 7 which further includes a partition in the housing dividing the housing into two portions, and the battery means and switch means are in one portion and the lamp means is in the other portion.

14. The apparatus of claim 13 which further includes mirror means in the other portion for reflecting light from the lamp means onto the photoluminescent material.

15. The apparatus of claim 7 in which the lamp means comprises a plurality of lamps.

* * * * *